United States Patent [19]

Smith

[11] Patent Number: 4,885,815

[45] Date of Patent: Dec. 12, 1989

[54] POWERED CLEANING TOOLS

[76] Inventor: Neville J. Smith, 6 Albemarle Terrace, London Road, Attleborough, Norfolk, England

[21] Appl. No.: 230,067

[22] Filed: Aug. 9, 1988

[30] Foreign Application Priority Data

Sep. 18, 1987 [GB] United Kingdom ..... 8721944

[51] Int. Cl.[4] ..... A46B 13/02

[52] U.S. Cl. ..... 15/28; 15/103

[58] Field of Search ..... 15/28, 29, 49 R, 97 R, 15/97 A, 103

[56] References Cited

U.S. PATENT DOCUMENTS 3,501,798 3/1970 Carraro ..... 15/103 X 4,299,004 11/1981 Lancaster ..... 15/28

FOREIGN PATENT DOCUMENTS 393455 6/1933 United Kingdom ..... 15/29

*Primary Examiner*—Edward L. Roberts

*Attorney, Agent, or Firm*—Edwin D. Schindler

[57] ABSTRACT

A powered tool for cleaning windows has an elongate, pointed tool body provided with a handle and housing an electric driving means for a plurality of shaft-mounted cleaning brushes exposed beneath the tool body and which include one inclined brush projecting downwardly and forwardly to protrude ahead of the pointed end of the tool body.

8 Claims, 4 Drawing Sheets

POWERED CLEANING TOOLS

FIELD OF THE INVENTION

This invention relates to a powered cleaning tool, and in particular to a powered tool for cleaning windows.

BRIEF SUMMARY OF THE INVENTION

According to the invention, there is provided a powered tool for cleaning windows which comprises a tool body adapted to be held by the hand, a plurality of cleaning elements projecting from the tool body generally on one side thereof, including at least one inclined cleaning element which projects at an angle outside the periphery of the body on the said one side thereof, and means within the tool body for driving the cleaning elements each in rotation substantially without displacement relative to the tool body.

The cleaning elements are preferably detachable from the tool body, and conveniently comprise a set of relatively stiff brushes for which can be substituted a set of relatively soft brushes or possibly polishing pads. The facility for detachment also enables the cleaning elements to be washed free of window cleaning fluid and/or dirt removed from the windows.

In a preferred arrangement, the cleaning elements are detachably mounted to the ends of rotatable shafts projecting from within the tool body. Within the tool body the shafts carry wheels to which a rotational drive is imparted by a belt which is in turn driven via a driving wheel on the output shaft of an electric motor. In the case of the inclined cleaning element or elements, the transmission also includes a bevelled friction wheel or bevel gear.

The electric motor is preferably adapted to be mains driven, but it is alternatively possible to use a battery driven motor, the batteries also being housed within the tool body and preferably being of the rechargeable type.

In the preferred arrangement, the tool body is elongate in the front to back direction, and has a plurality of, conveniently three, longitudinally spaced detachable cleaning elements arranged in a line adjacent each longitudinal edge of the underface of said body but generally within the periphery of said underface. At the front, the body tapers to a somewhat pointed leading end, and a single angled cleaning tool is positioned to project downwardly and forwardly in front of this leading end of the body.

BRIEF DESCRIPTION OF DRAWINGS

A practical example of powered cleaning tool in accordance with the invention, especially intended for cleaning windows, is diagrammatically illustrated in the accompanying drawings, in which.

DESCRIPTION OF EMBODIMENT

The illustrated tool has a tool body which includes a cover 10 incorporating a handle means 12, the cover being snap-fitted to a tool body base plate 14.

Figure 2:
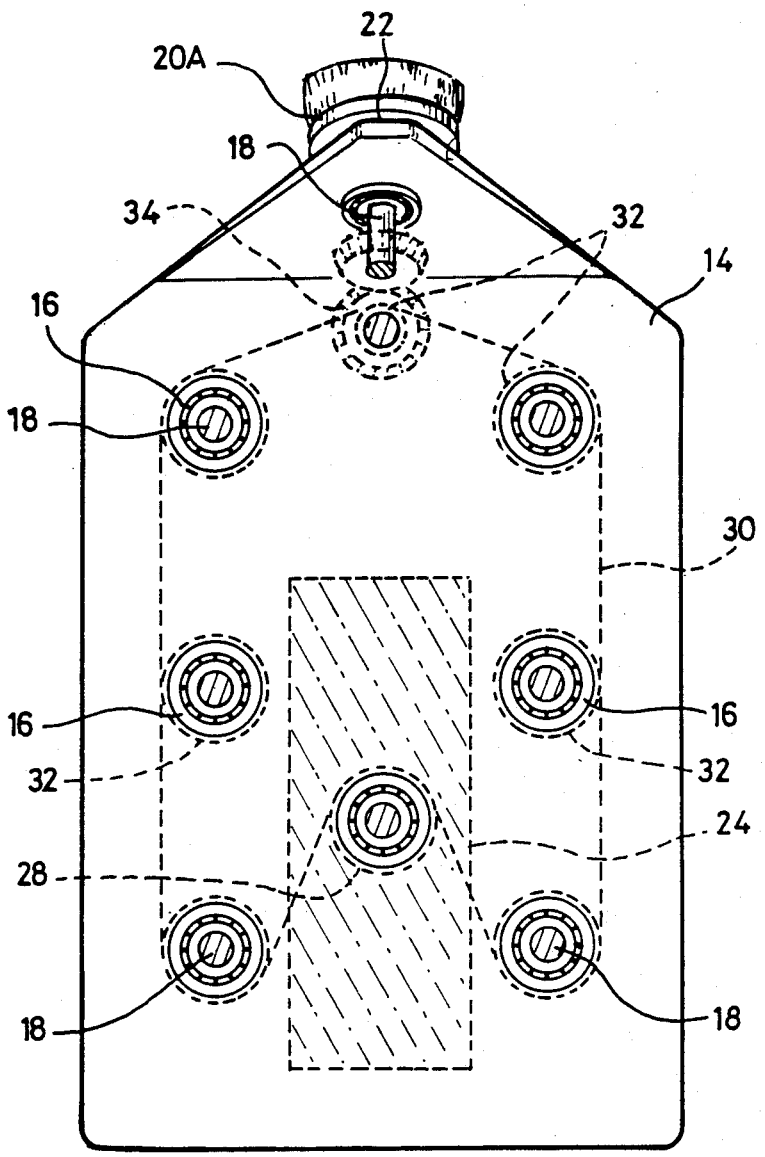
FIG. 2 is a plan view of a tool body base plate.
Figure 3:
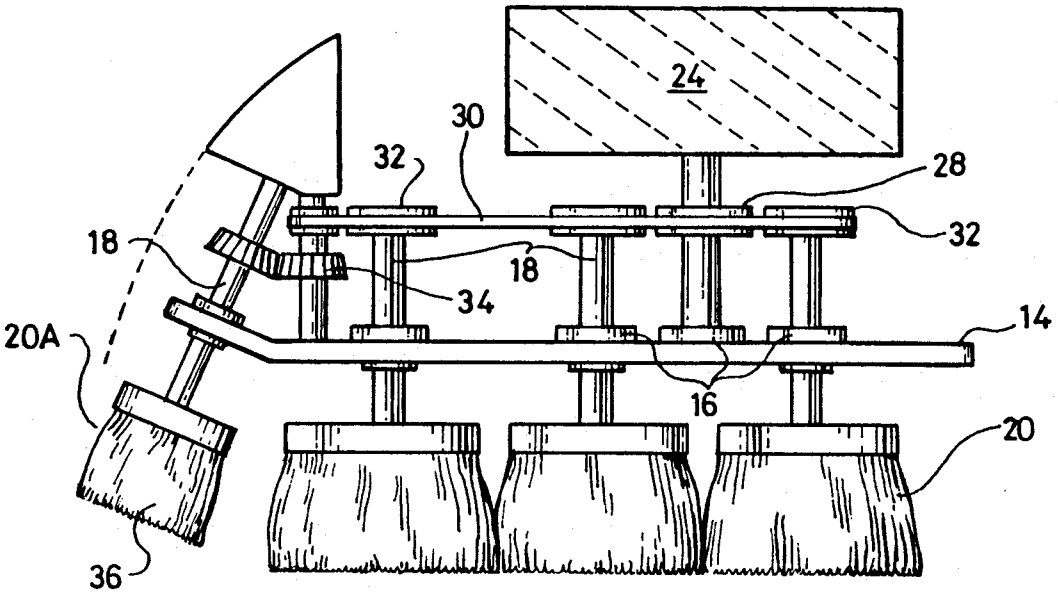
FIG. 3 is a side elevational view of the tool, the tool body cover being removed from the tool body base plate.
Figure 5:
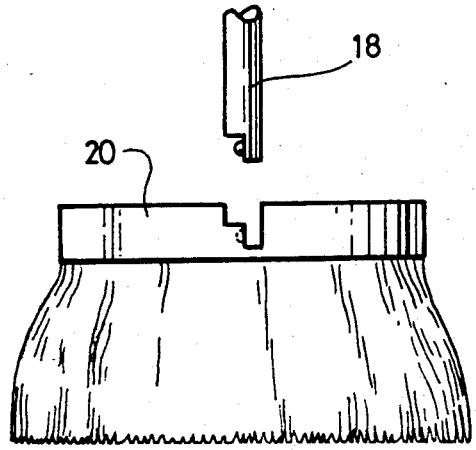
FIG. 5 shows the mounting for a cleaning brush.

The base plate 14 (see also FIGS. 2 and 3) incorporates bearings 16, conveniently of plastics material incorporating a ball bearing, for a number of rotatable shafts 18, which project to the underside of the tool body and are adapted detachably to receive a set of cleaning brushes 20, as indicated by the mounting in FIG. 5. The tool body is elongate in the front to back direction, and tapers to a leading end 22 at which point one cleaning brush 20A projects in an inclined manner downwardly and forwardly at an angle, thereby to protrude ahead of the said leading end 22 of the tool body.

Figure 1:
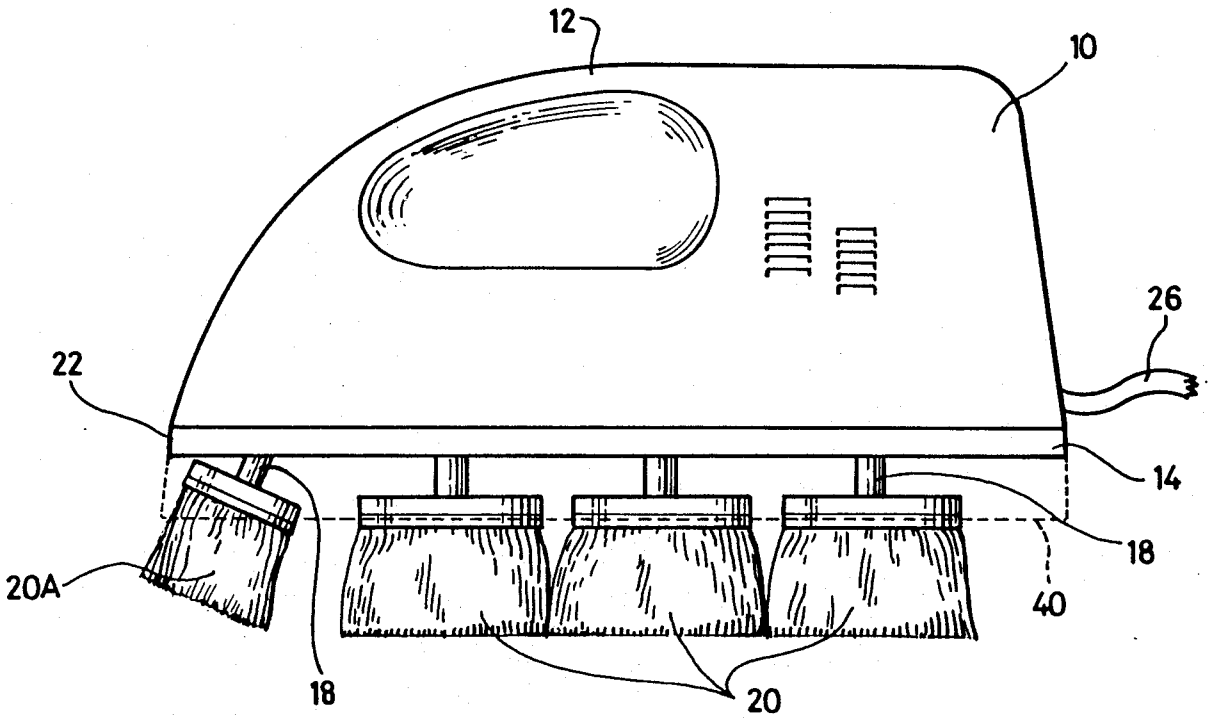
FIG. 1 is a side elevational view of the tool.
Figure 4:
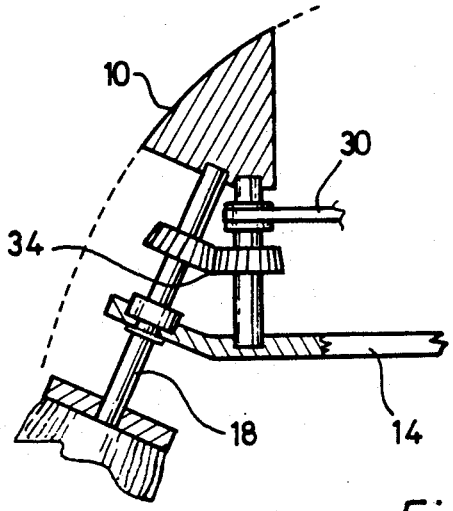
FIG. 4 is a scrap view showing a bevel gear arrangement.

Mounted to the base plate 14 within the tool body is an electric motor 24 to which power is fed from the mains supply through a flexible cable 26 (FIG. 1). A drive wheel 28 on the output shaft of the motor drives an endless band or belt 30 which drives the cleaning brush shafts 20, 20A in rotation via driven wheels 32 provided on said shafts. The transmission to the angled cleaning element 20A also includes a bevel gear 34, also shown in FIG. 4. It is possible, however, that a bevelled friction wheel coupling is to be preferred to the illustrated bevel gear.

As indicated in broken line in FIG. 1, a peripheral safety guard 40 may be provided on the tool body.

In one example, the tool body is about 15 cm long and 10 cm wide, and has six brushes of about 4 cm diameter projecting directly downwardly from its underface and one angled brush of about 1.25 cm diameter projecting downwardly and forwardly beyond the body periphery at its leading end. This angled brush 20A may have a tapered pack 36 of bristles, generally as illustrated.

In use, a cleaning fluid is first sprayed or otherwise deposited on to the window glass, and the tool is fitted with a set of relatively stiff brushes, switched on, and traversed by hand over the glass to effect primary cleaning. The tool is then switched off, fitted with a set of relatively soft brushes, and again traversed over the glass to effect final cleaning and polishing. After window cleaning has been completed, both sets of tools can be washed. Polishing pads may be substituted for the soft brushes, or used afterwards.

The cleaning elements may be driven at a speed of say several hundred r.p.m., preferably under a power low enough to quickly cause the motor to stall if an undue obstruction is encountered within the guard.

The angled and somewhat pointed cleaning brush 20A at the front of the tool is particularly important to enable the effective cleaning of corners of the window panes.

It will be appreciated that the above-described and illustrated embodiment may be modified in various ways within the scope of the invention defined in the appended claims.

I claim:

1. A powered tool for cleaning windows which comprises:

a tool body having an underside and an upperside where at said tool body is adapted to be held by a hand of a user, said tool body being elongate in a front to back direction and being tapered to a substantially pointed leading end at the front;

a plurality of cleaning elements projecting from said tool body on the underside thereof, including an inclined cleaning element which projects downwardly and forwardly in front of the leading end of said tool body; and, means within said tool body for driving said plurality of cleaning elements, said cleaning elements each being driven in rotation substantially without displacement relative to said tool body.

2. A tool according to claim 1, including means wherein the cleaning elements are detachable from said tool body.

3. A tool according to claim 2, having rotatable shafts projecting from within the tool body, the cleaning elements being detachably mounted to ends thereof.

4. A tool according to claim 3, wherein said means for driving said plurality of cleaning elements includes the rotational shafts which carry wheels to which a rotational drive is imparted by a belt driven via a driving wheel on an output shaft of an electric motor.

5. A tool according to claim 4, wherein the inclined cleaning element is driven through a coupling which includes a bevel wheel.

6. A tool according to claim 4, wherein said means for driving said plurality of cleaning elements includes a mains electric driving motor within the tool body and a power supply cable entering the tool body at the rear end thereof.

7. A tool according to claim 1, wherein said plurality of cleaning elements are spaced apart in line adjacent a longitudinal edge of the underface of said tool body and generally within the periphery of said tool body.

8. A tool according to claim 1, wherein the tool body includes a base plate providing support for the rotatable cleaning elements and a cover which includes handle means and detachably fits to the base plate to enclose the driving means for the cleaning elements.

* * * * *